US005881890A

United States Patent [19]

Wiley

[11] Patent Number: 5,881,890

[45] Date of Patent: Mar. 16, 1999

[54] MAIL SORTING SYSTEM AND PROCESS

[76] Inventor: Ken Wiley, 750 Circle Dr., Mountain City, Tenn. 37683

[21] Appl. No.: 668,214

[22] Filed: Jun. 21, 1996

[51] Int. Cl.[6] ..... B07C 7/04

[52] U.S. Cl. ..... 209/703; 209/900

[58] Field of Search ..... 209/584, 549, 209/702, 703, 706, 900; 364/478.12, 478.14

[56] References Cited

U.S. PATENT DOCUMENTS

| | | | |
|---|---|---|---|
| 4,181,948 | 1/1980 | Jackson et al. | 209/549 X |
| 4,921,107 | 5/1990 | Hofer | 209/546 |
| 5,311,597 | 5/1994 | Rosenbaum . | |

*Primary Examiner*—David H. Bollinger
*Attorney, Agent, or Firm*—Arthur F Zobal

[57] ABSTRACT

The system includes a plurality of bins. Each bin has electrical circuitry including an infrared emitter and detector, a guiding light and a warning light. The circuitry of each bin is controlled by a computer and an input/output controller. The computer reads the bar code address on the envelope via a scanner. The address can also be typed in from the keyboard or input by speaking into a mike. The computer searches through its' data base for the address and then sends the bin number for that address to the Input/Output Controller. The I/O Controller includes a plurality of input lines leading from the detectors and a plurality of output lines leading to the guiding lights and warning lights of the bins. When the computer sends the address number to the I/O Controller, the I/O Controller lights the correct guiding light. If the mail piece is sensed in that bin, the guiding light in that bin goes off and the next piece of mail can be scanned. If the mail piece is placed in any other bin the warning light of that other bin comes on and the guiding light of the correct bin stays on to show the correct bin the mail piece should go in. When the mail piece is taken out of the incorrect bin and placed in the correct bin the warning light and the guiding light go off and the computer is ready to scan the next envelope.

5 Claims, 18 Drawing Sheets

101
103
63P
64P
60P
61P
57P
58P
54P
55P
51P
52P
65P
62P
59P
56P
53P
87
105
81
107
83

MAIL SORTING SYSTEM AND PROCESS

BACKGROUND OF THE INVENTION

1. Field of the Invention

The invention relates to a system for facilitating the sorting of mail into a plurality of bins.

2. Description of the Prior Art

U.S. Pat. Nos. 4,181,948; 4,921,107; and 5,311,597 relate to different types of mail sorting systems.

SUMMARY OF THE INVENTION

It is an object of the invention to provide a simple and economic mail sorting system comprising structure having a plurality of bins. Each bin has electrical circuitry comprising a sensing means a guiding light and a warning light. The circuitry of each bin is controlled by a computer and an input/output controller.

The computer reads the bar code address on the envelope via a scanner. The address can also be typed in from the keyboard or input by speaking into a mike. The computer searches through its' data base for the address and then sends the bin number for that address to the Input/Output Controller. The I/O Controller includes a plurality of input lines leading from the sensing means and a plurality of output lines leading to the guiding lights and warning lights of the bins. When the computer sends the address number to the I/O Controller, the I/O Controller lights the correct guiding light. If the mail piece is sensed in that bin, the guiding light in that bin goes off and the next piece of mail can be scanned. If the mail piece is placed in any other bin the warning light of that other bin comes on and the guiding light of the correct bin stays on to show the correct bin the mail piece should go in. When the mail piece is taken out of the incorrect bin and placed in the correct bin the warning light and the guiding light go off and the computer is ready to scan the next envelope.

BRIEF DESCRIPTION OF THE DRAWINGS

FIG. 8 is the system flow chart.

FIG. 9 is the main program flow chart.

FIG. 10 is the Log in operator procedure.

FIG. 11 is the Log out operator procedure.

FIG. 12 is the select mail sort scheme procedure.

FIG. 13 is the sort mail by scheme procedure.

FIG. 14 is the accept commands procedure.

FIG. 15 is the process mail codes procedure.

FIG. 16 is the convert mail code to bin number procedure.

FIG. 17 is the signal bin number procedure.

FIG. 18 is the receive mail placement signal procedure.

FIG. 19 is the signal placement error.

FIG. 20 is the do address database search procedure.

DESCRIPTION OF THE PREFERRED EMBODIMENT

Figure 1:
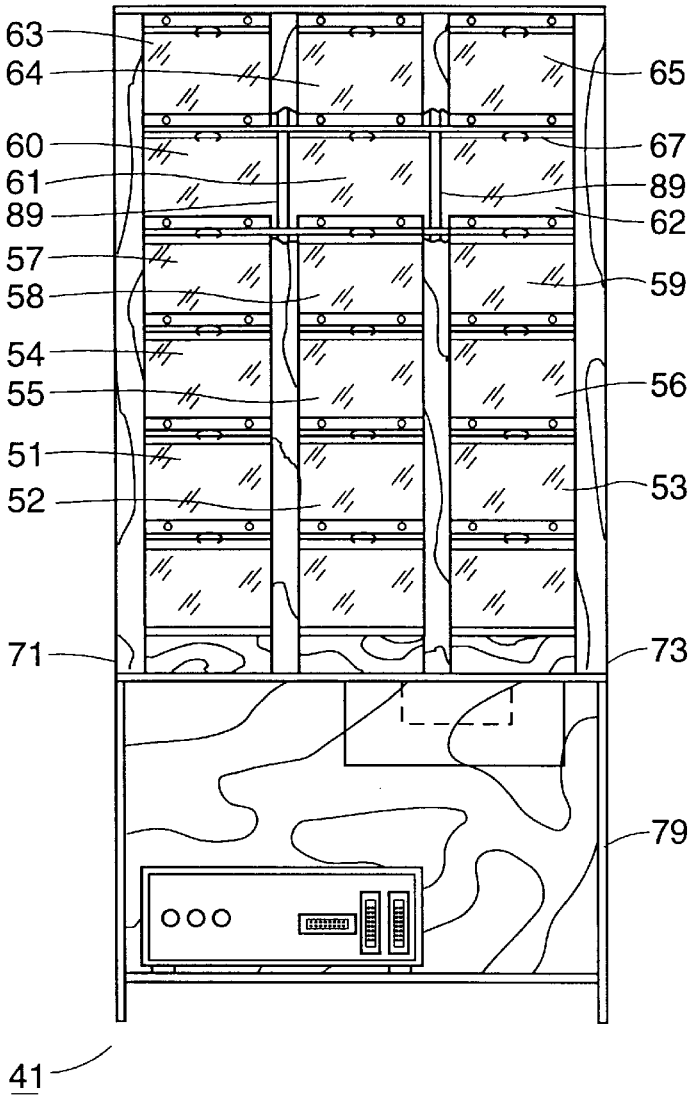
FIG. 1 is a front plan view of a cabinet of the invention showing its bins.
Figure 2:
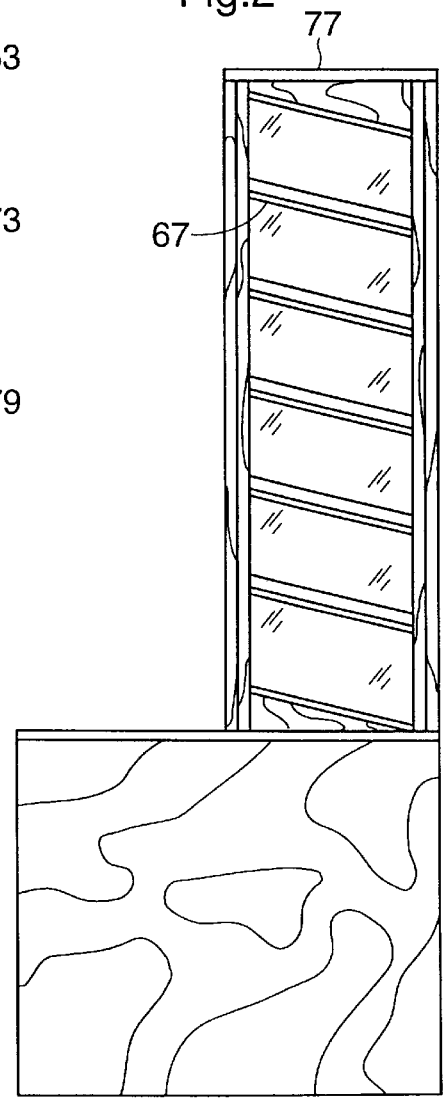
FIG. 2 is a side view of the cabinet of FIG. 1.
Figure 4:
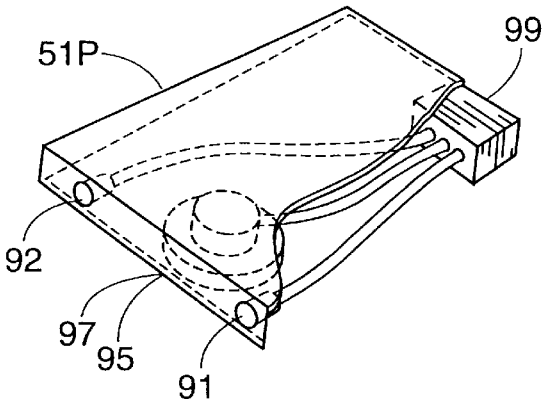
FIG. 4 illustrates the components of one of the platters.
Figure 3:
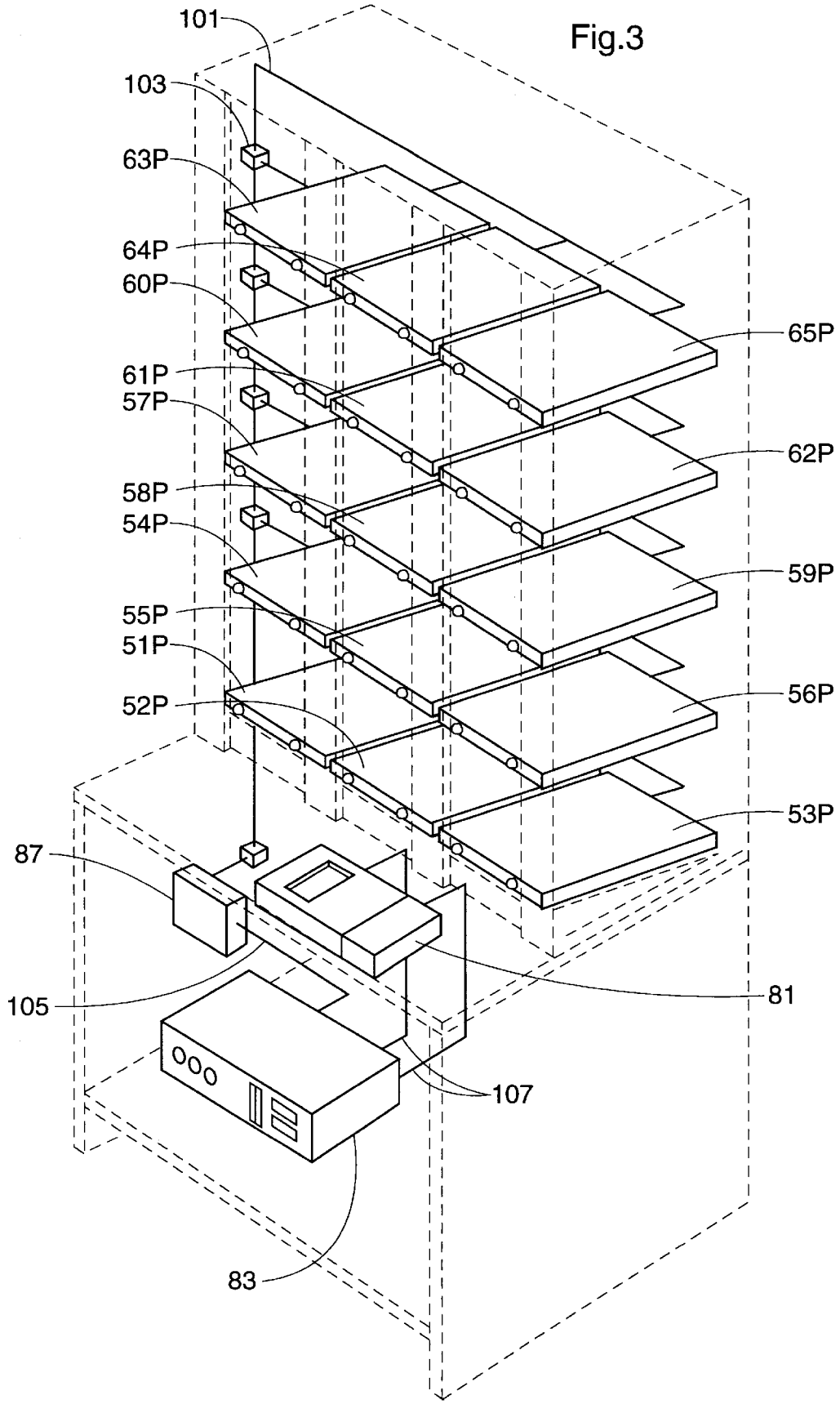
FIG. 3 is an isometric view of the sorting platters computer, power supply, and scanner of the invention.
Figure 5:
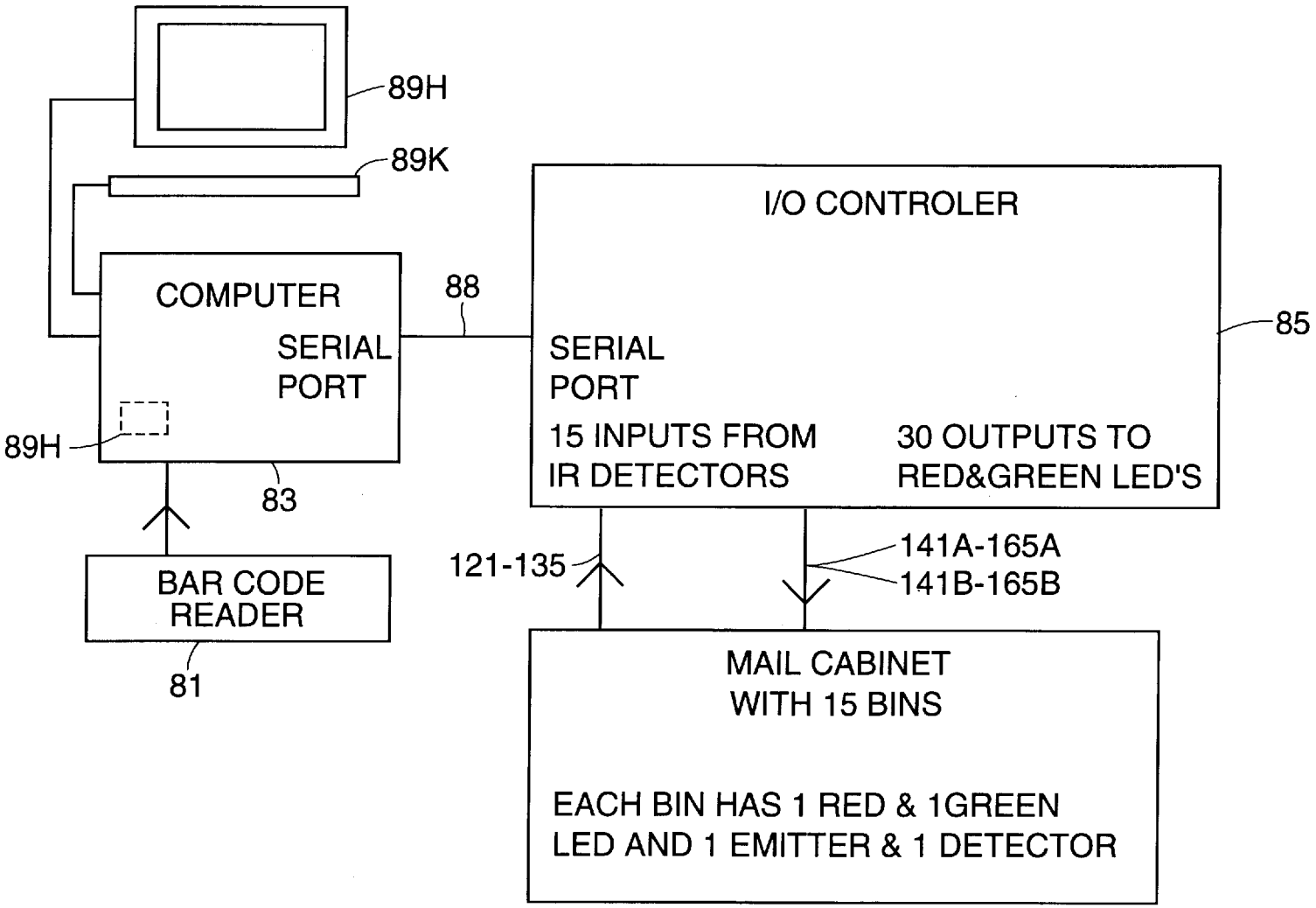
FIG. 5 is a schematic of the invention including a bar code reader, a computer, an input/output controller and the mail cabinet of the invention.
Figure 6:
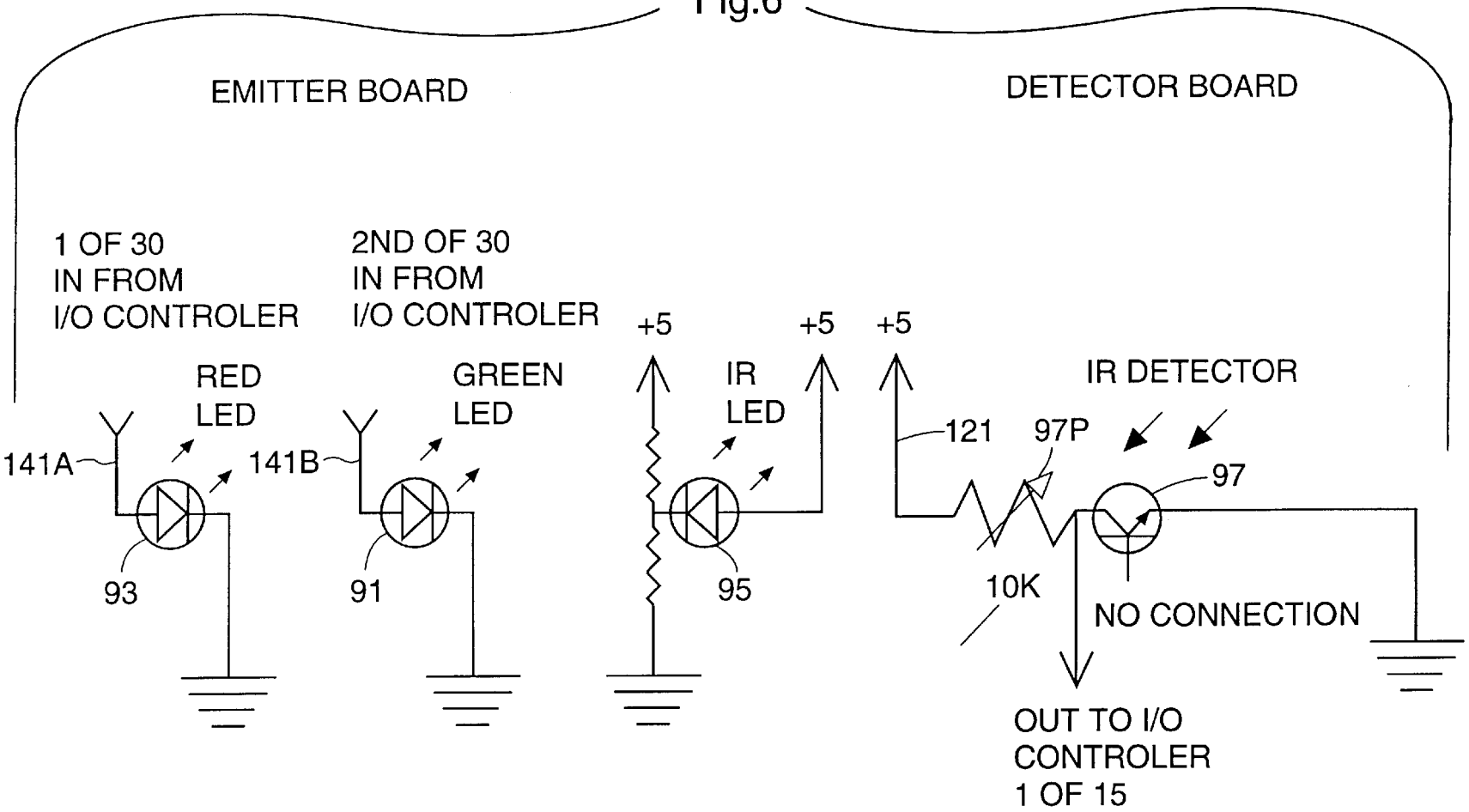
FIGS. 6 and 7 illustrate the electrical components of two of the platters of the invention.
Figure 7:
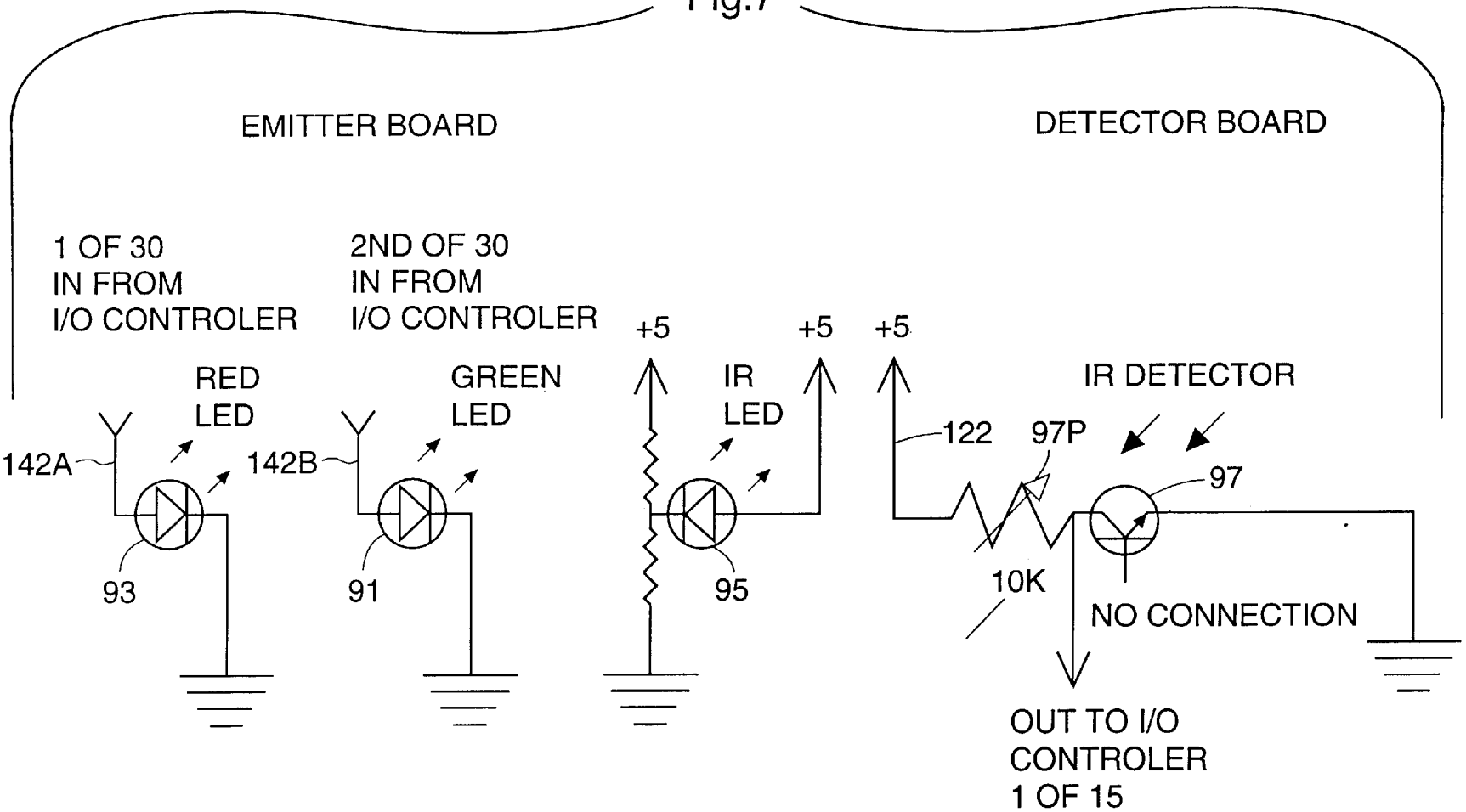

Referring to the FIGS. 1–6, there is disclosed a mail cabinet 41 having a plurality of mail bins 51–65 which include platters 51P–65P respectively. The platters are supported in rows by shelves 67 such that their front ends are higher than their rear ends. The platters form the bottom support of the mail to be inserted into the bins. The front of each bin is open. The cabinet 41 has two outer sides 71 and 73 formed of panels of clear plastic, a back wall 75, a top wall 77 and a base structure 79 that supports a scanner 81, a computer 83, an input/output controller 85, and a power supply 87. Adjacent bins on each row are separated by an interior vertical wall 89. The computer 83 includes a conventional keyboard 89K and monitor 89M and a hard drive 89H.

Each platter has a green LED 91, a red LED 93, an infrared emitter 95, an infrared detector 97, and a power connection means 99. The LEDs 91 and 93 are at the front of the platters. The various power connecting means 99 are coupled by lead 101 and connectors 103 to the power supply 87 which is coupled to the computer 83 by lead 105. The scanner 81 is coupled to the computer 83 by leads 107. For each pair of emitter-detector 95 and 97, the beam from the emitter 95 to the detector 97 is broken by placing a mail piece in the emitter-detector pair bin.

Each bin has an infrared emitter 95 that emits an infrared beam to its associated sensor 97.

The computer 83 reads the bar code address on the envelope or mail piece via the scanner 81. The address can also be typed in from the keyboard or input by speaking into a mike. The mail pieces may be of the type received from other individuals or entities or in-house mail pieces. The computer searches through its' data base for the address and then sends the bin number for that address out through the serial port, to the Input/Output Controller 85 (I/O Controller). The I/O Controller 85 has 15 Input lines 121–135 and 30 Output lines 141A–165A, 141B–165B. There is also Decoder Logic that takes the hex number from the computer and decodes it to light the correct LED. The output lines are connected to 15 pairs of LED's—one Red and one Green. Each pair is mounted in a bin shelf along with the Infrared emitter 95 and sensor 97. The 15 Input lines 121–135 are connected to the Infrared sensors 97. When the computer sends the hex address number to the I/O Controller, the I/O Controller lights the green LED on the appropriate bin. If the envelope breaks the Infrared beam in that bin, the green LED goes off and the next piece of mail can be scanned. If the beam in any other bin is broken a red LED comes on in that bin and the green light stays on show the correct bin the envelope should go in. When the envelope is removed from the incorrect bin, and placed in the correct bin and the Infrared beam in the correct bin is broken then all the LED's go off and the computer is ready to scan the next envelope. Each scan can be cancelled and reset at any time by pressing a key on the keyboard.

It is to be understood that the system may use more or less than 15 bins depending on the situation and conditions.

The computer used may be a conventional 486 or Pentium PC computer manufactured by IBM having a hard drive, a floppy disk, or CD Rom, a monitor, and a keyboard or mouse capable of using 3.1 Windows or Windows '95 operating system. The scanner 81 is a commercial unit.

The input/output controller is a commercially available unit from Electronic Energy Control, Inc. of Columbus, Ohio identified as STA-16. It has 16 outputs and 8 inputs. It has been modified to have 30 outputs and 15 inputs. The 15 leads 121–145 are coupled to its 15 inputs and its 30 outputs are connected to the 30 leads which comprise 15 pairs of leads 141A–165A and 141B–165B coupled to the red and green LEDs. For example, leads 141A, 141B, 121 are coupled to the red LED, green LED, and detector 97 respectively of bin 51 and leads 142A, 141B, 122 are coupled to the red LED, green LED, and detector 97 respectively of bin 52. The unit 85 is always sensing the 15 detectors 97 and if information is obtained, it encodes the information and sends it to the computer by way of lead 88. The computer responses by sending information back to the unit 85 by lead 88 which then send information to the appropriate platters 51P–65P to control the appropriate LEDs.

If a beam is broken, the unit 85 senses a voltage change from the appropriate detector 97 and tells the computer that a beam has been broken. The voltage change will be a voltage drop across the potentiometer 97P which tells the computer that a beam has been broken.

Reference now will be had to FIGS. 8–20 for a description of the operation of the computer for operating the system of FIGS. 1–7. The programs of FIGS. 8–20 are stored on the hard drive 89H which is a computer readable memory.

Figure 9:
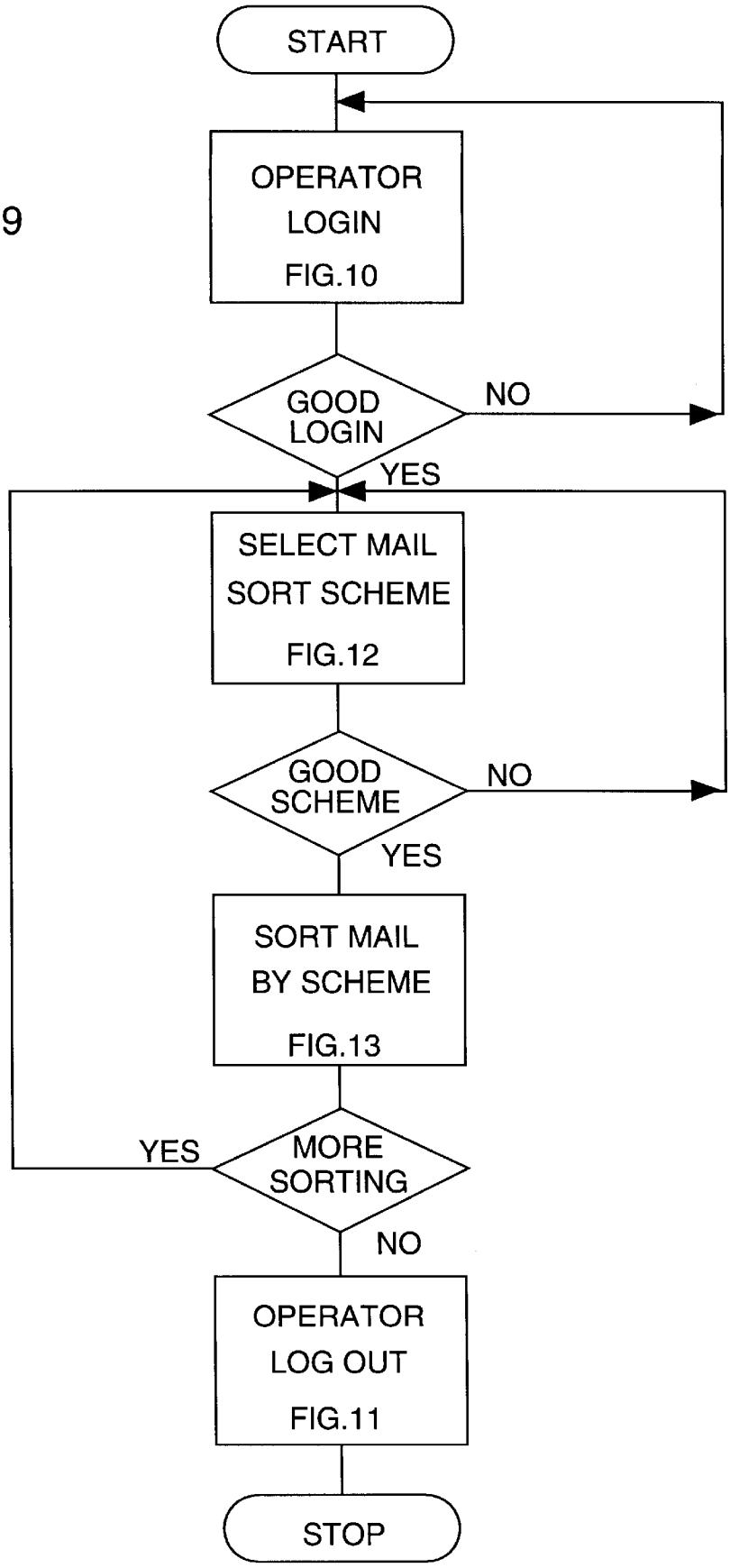
Figure 14:
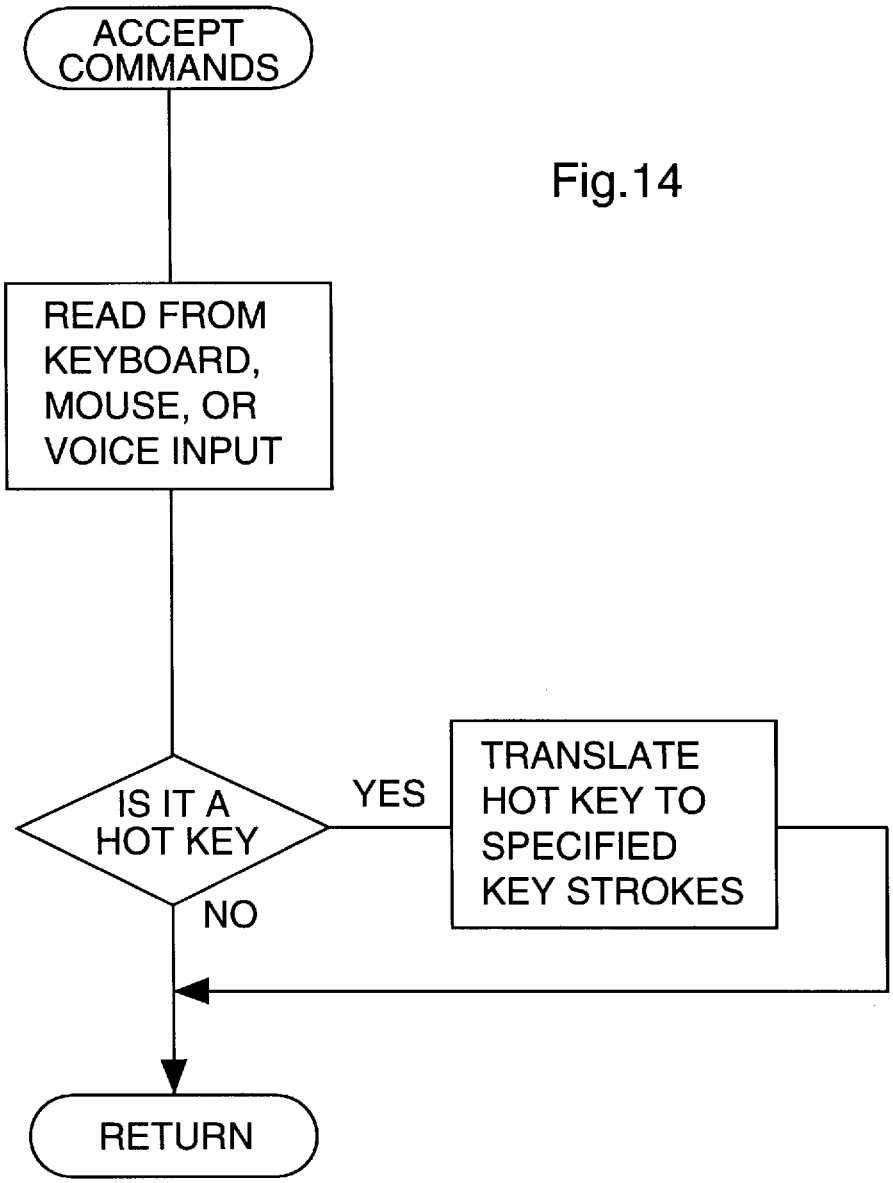
Figure 15:
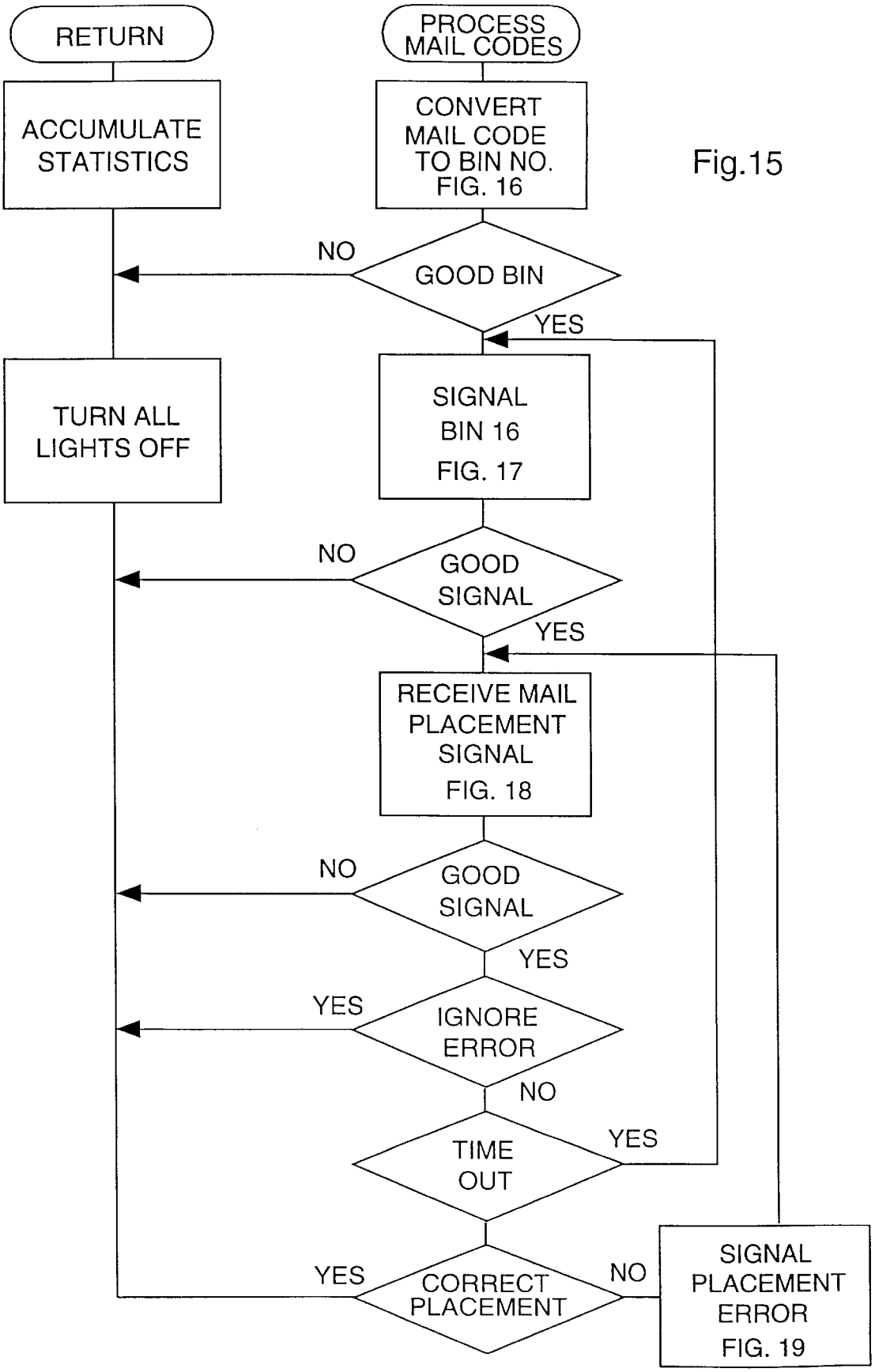
Figure 16:
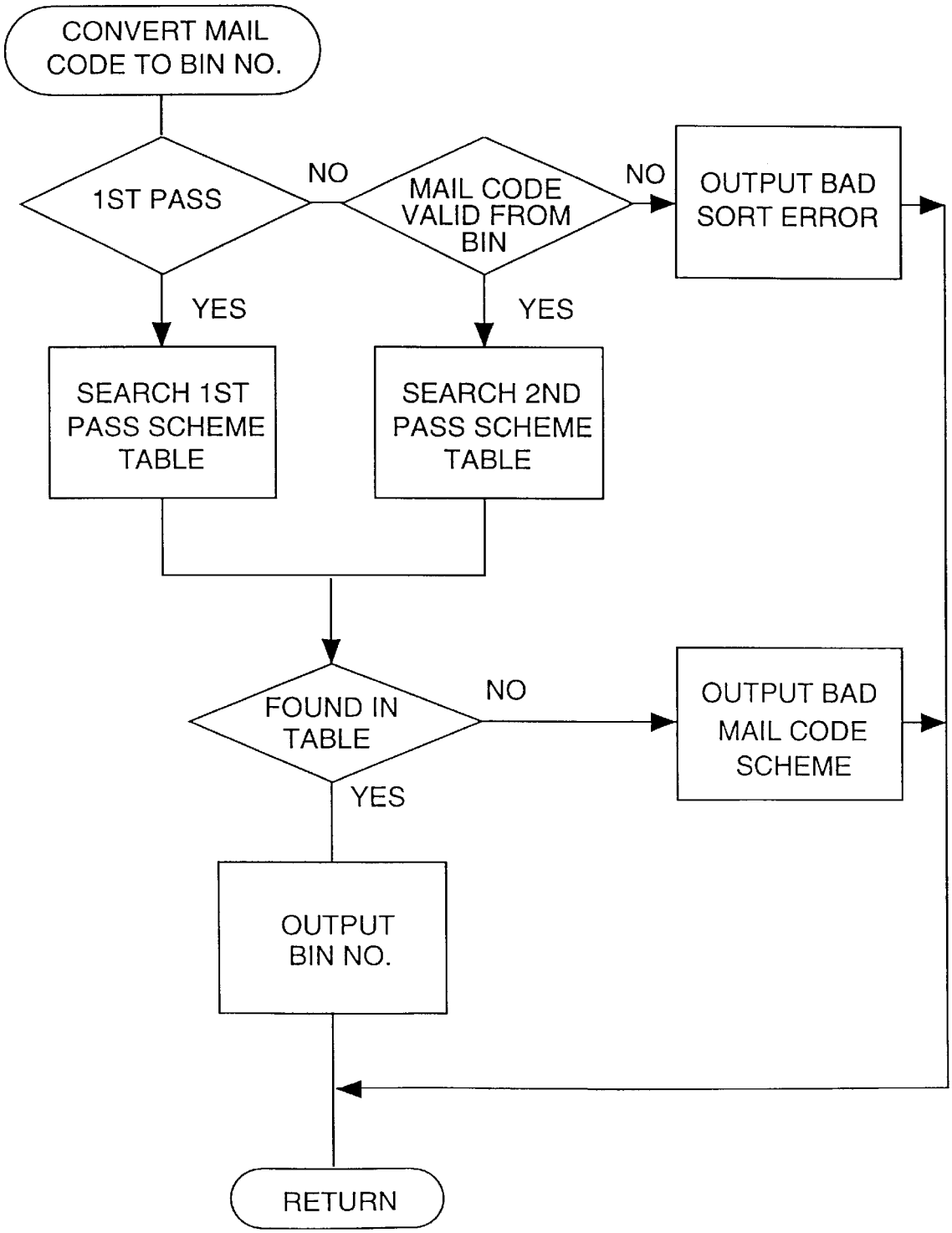
Figure 17:
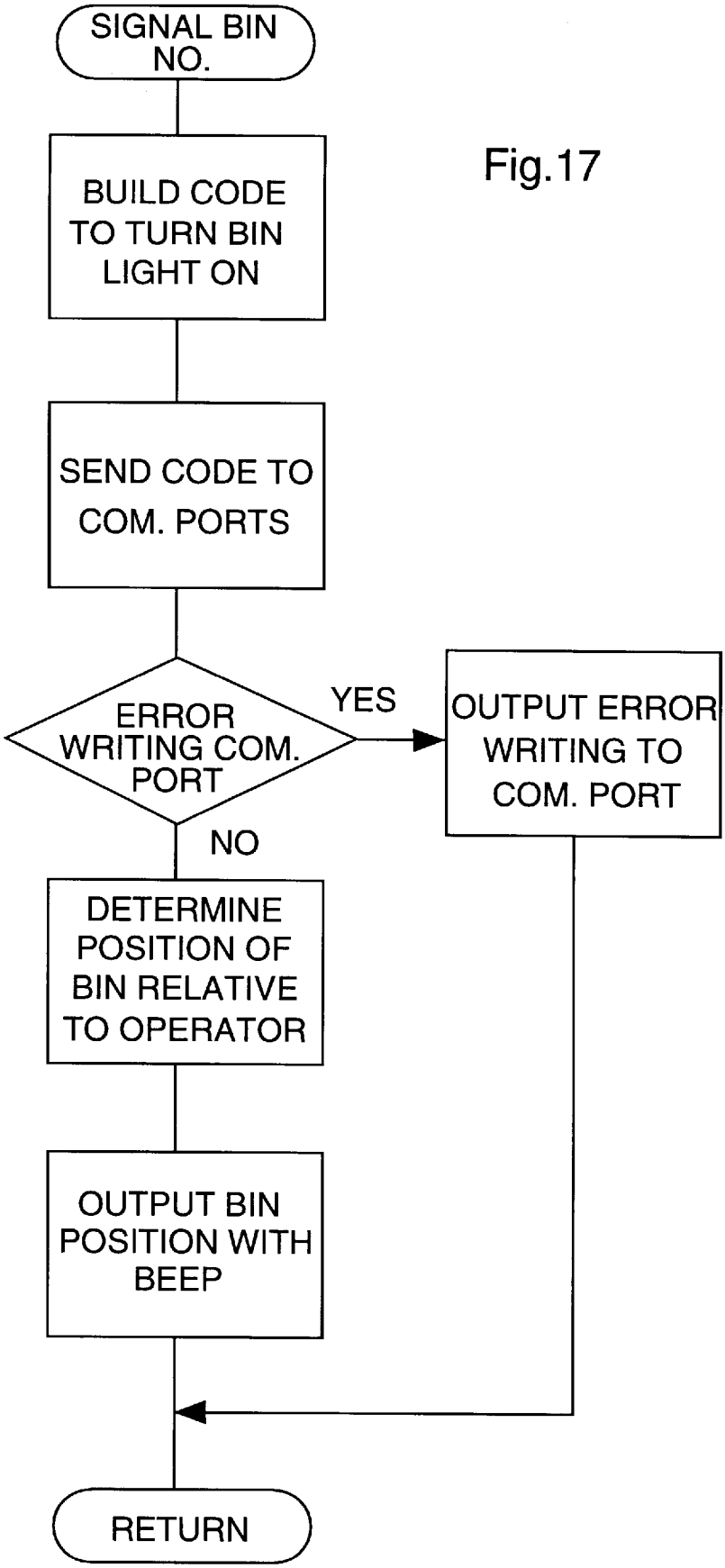
Figure 18:
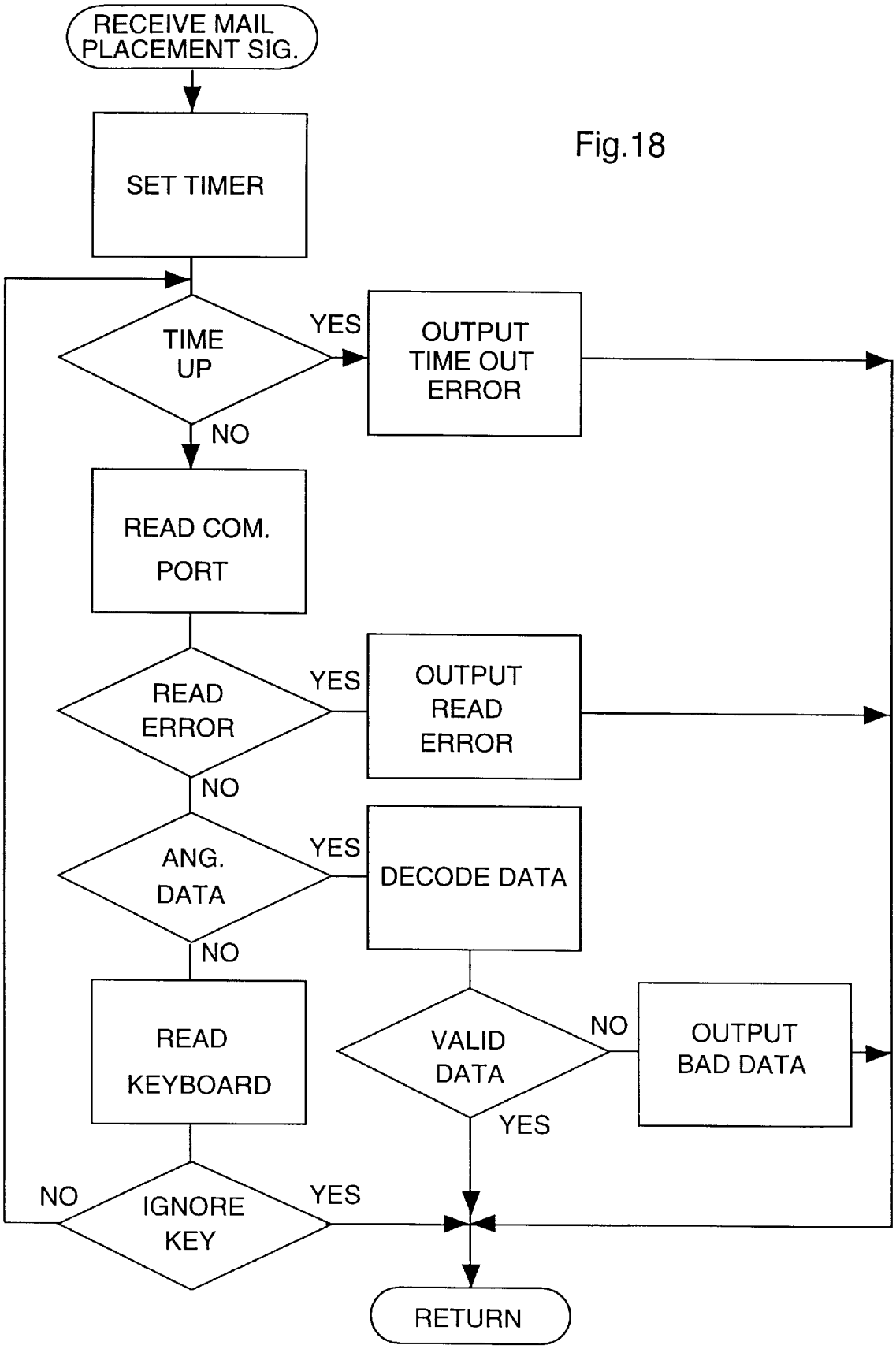
Figure 20:
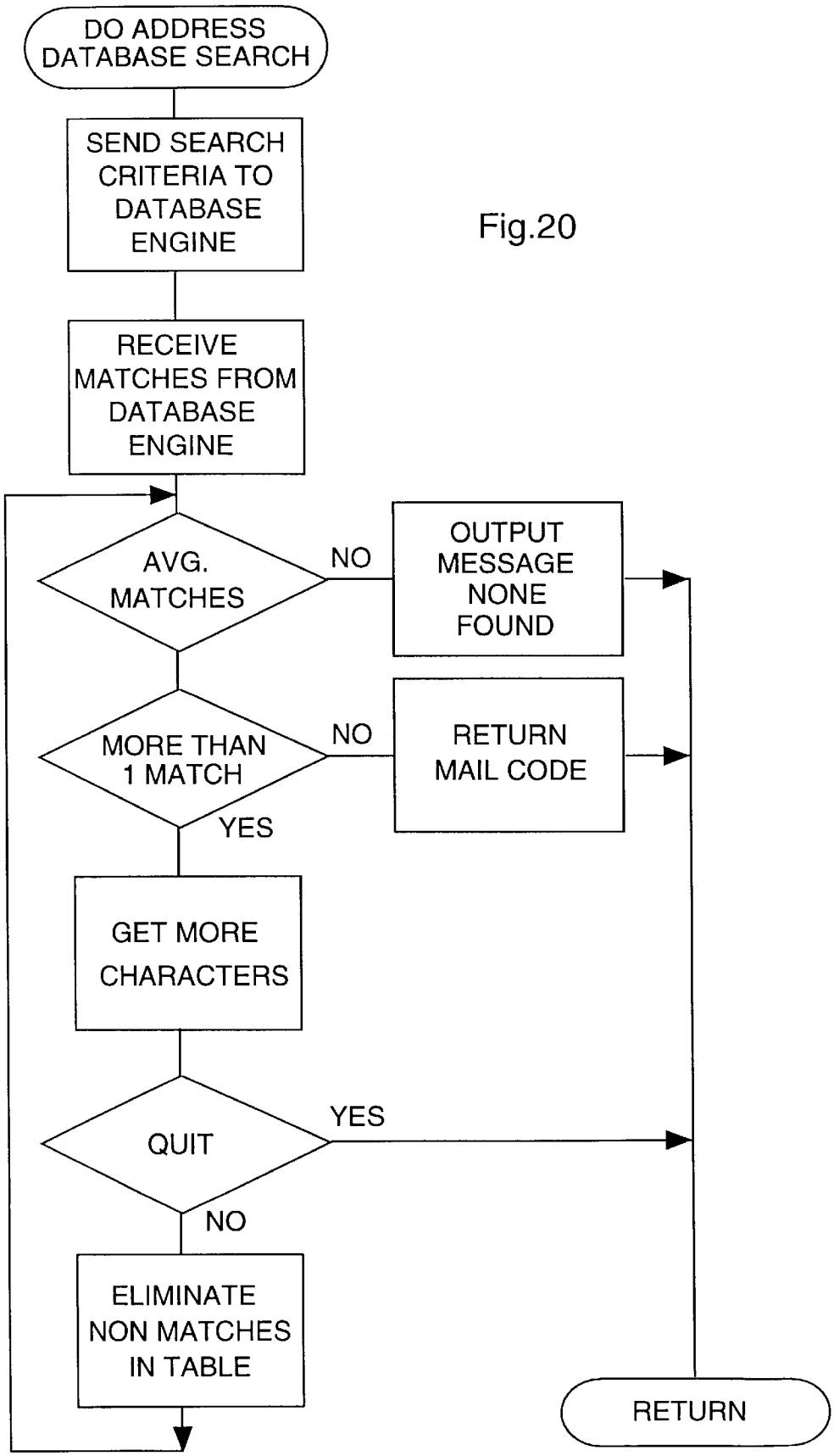

The programs of FIGS. 10, 12, 13, and 11 are part of the program of FIG. 9. The programs of FIGS. 14, 15 and 20 are part of the program of FIG. 13. The programs of FIGS. 16, 17, and 18 are part of the program of FIG. 15. The description initially will start with FIG. 15.

Referring to FIG. 15, when a i.e. 5 digit mail code has been read, it is converted to a bin number. This is disclosed in FIG. 16. If it was a good bin number, the electronic hardware that is attached to the computer is signaled to turn a particular green light on for i.e. bin number 3. Note FIG. 17. The green light is turned on indicating to the operator to place that piece of mail in that bin. If there is a signaling problem, i.e., that signal did not turn that light on, the system returns. If any lights are on, the system turns the error lights off. The system is told that if a good signal was not obtained from the hardware to accumulate statistics. The system goes to return.

If the system was able to tell the hardware to turn that light on, the system will want to know if the correct light came on. That is shown in FIG. 18. The procedure of FIG. 18 goes through and determines if the correct light has came on. If for some reason the system is having other problems such as not getting information back, the operator can hit a key on the keyboard to tell the computer to ignore this (Ignore Error) and get ready to read another mail piece. For some reason, if the operator may have placed the mail piece in the wrong bin and wants to leave it there, the operator can tell the computer to ignore the problem. There can also be a time out situation in that the operator does not place the mail piece in the bin within a given time period.

The mail placement signal also has a timer on it. It will wait for a given time period and return.

From the receive mail placement signal, if the operator places the mail piece in the right bin, everything is satisfactory and the system returns. If the operator places the mail piece in the wrong bin, then the signal will be a placement error, which turns the red LED on in the incorrect bin telling the operator that the mail piece was placed in the wrong bin. The green LED is still on in the correct bin. The operator takes the mail piece out of the wrong bin, and when the operator places the mail piece in the correct bin, the red LED turns off and the green LED turns off. Placement of the mail piece in the correct bin causes the red LED and the green LED to be turned off.

Referring to FIG. 16, when a 5 digit mail code has been read by the scanner and computer it is converted to a bin number. The sorting scheme is broken down into two pass scheme tables. For example, there may be 30 bin system but there may be i.e. 500 potential mail codes. The system may be broken down such that 15 mail codes go in the first bin, 15 mail codes go in the second bin, etc. Mail still may not be sorted or converted enough so a second pass scheme table is provided to sort mail from a given bin further. The "From Bin" block indicates that the system knows which bin a given piece of mail is to be sorted from the first pass. The error blocks indicate that the mail should not have been sorted in a given bin to begin with and the process returns.

FIG. 17 is the signal bin number procedure and is the logic that deals with turning the lights on. Build code to turn bin light on tells the hardware connected to the computer that there is a particular code to be sent to tell the hardware to turn i.e. the bin green light No. 3 on. It sends the code to the communications port. The hardware is connected to a serial port on the back of the computer. If there is an error the system returns. If the error occurs a second time, the operator realizes the hardware needs to be examined.

There may be three bin cabinets located in a U position. The "determine position of bin relative to operator" and "output bin position with beep" helps the operation to know if the mail goes in the left, middle or right cabinet. For example, the system may beep once for mail that goes to the left cabinet, twice for mail that goes to the center cabinet, and three times for mail that goes in the right cabinet.

Referring to FIG. 18, the system is waiting for a signal from one of the photocells to indicate that the mail has been placed in a particular bin. It sets a timer to i.e. 20 or 30 seconds. If no signal is received after the set time period, something needs to be done. The system reads the communication port to determine if there is a signal. If there is an error, then the system outputs a read error since there may be i.e. a hardware error and the system wants to know about it. If there is no data the keyboard is read which may be ignored or returned.

The output time out error waits for the time out period and then goes to return.

The output read error determines if the data was valid or in the right place.

The output bad data determines if i.e. there is a hardware or software problem. The errors go back to return which is the procedure of FIG. 15.

Figure 19:
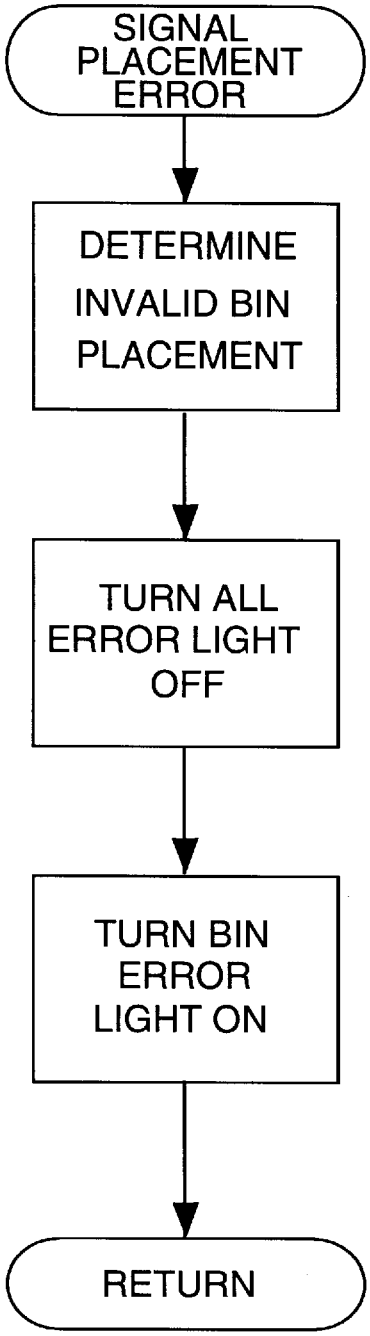

The signal placement error of FIG. 19 determines if the mail was placed in the correct bin and if not, the bin error red light is turned on.

Figure 13:
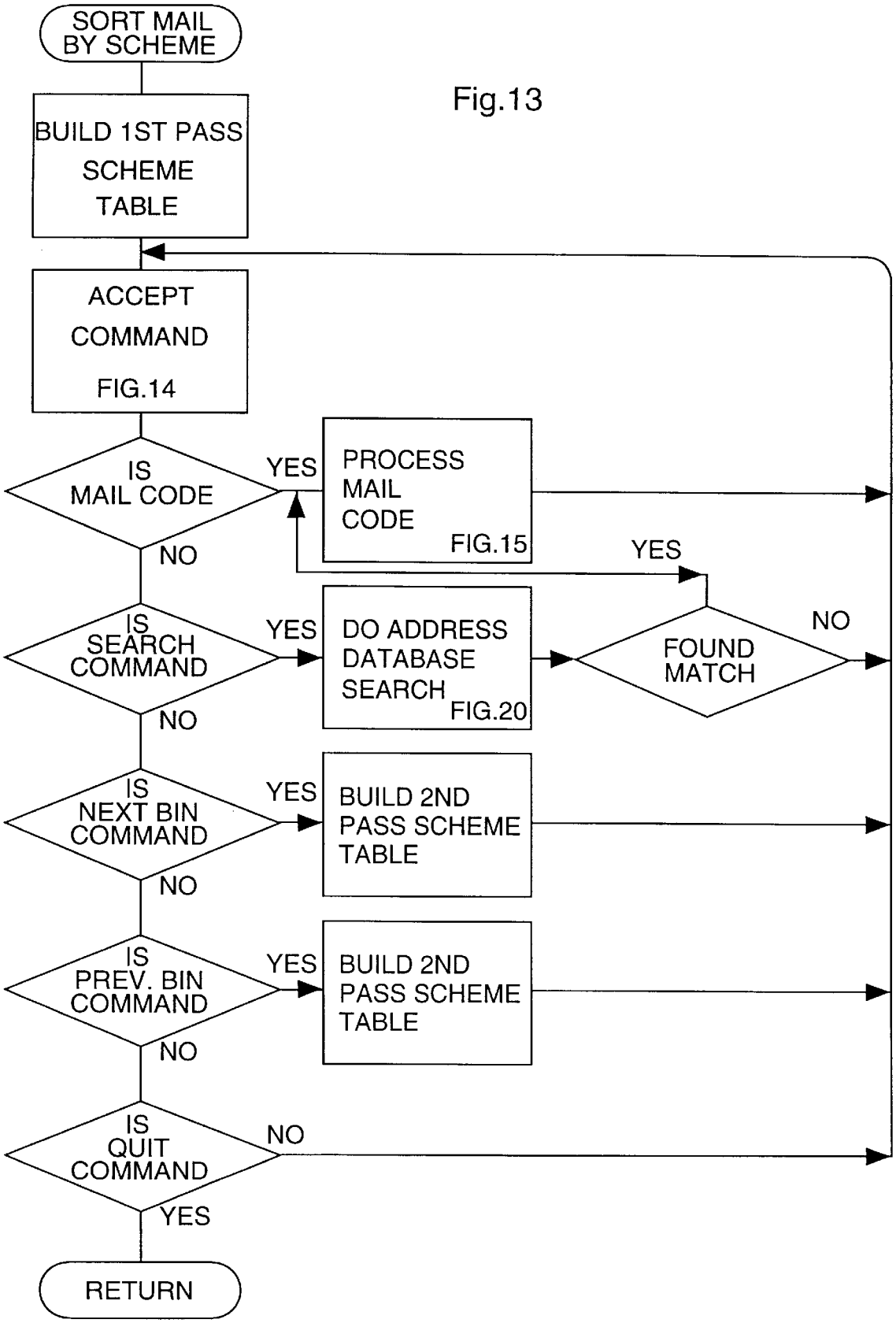

The do address data base search of FIG. 20 is the address data base search of FIG. 13. If a match is found the process goes back in to process the mail code of block 14 of FIG. 13 which is the procedure of FIG. 14.

Reference now will be had to FIGS. 8–15 of the flow charts.

Figure 8:
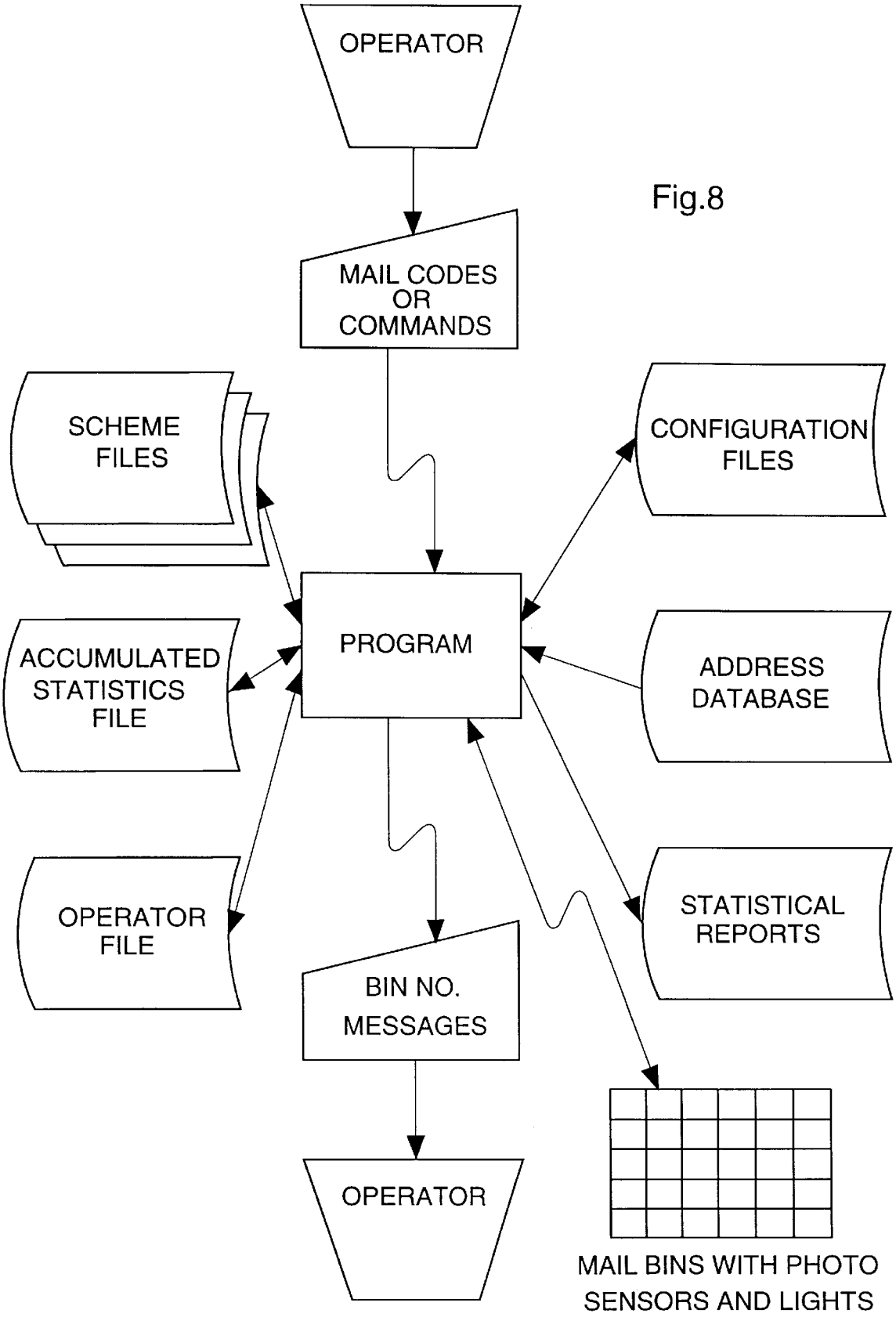
FIGS. 8–20 are flow charts of the programs that are stored in the computer and which the computer goes through in operating the system of the invention.

Referring now to FIG. 8, the configuration files relate to things such as the layout of the cabinets. The address data base is a data base of all of the addresses. If necessary the system can read the addresses of a particular mail item and determine its mail code. The statistical reports may relate to operator efficiency, number of pieces that went into a particular bin for a particular mail code. The mail codes may be inputted by keyboard, voice, or a scanner. The scheme files relate to the sorting schemes. The accumulate statistic files relate i.e. to the number of pieces of mail sorted on a given day, how many errors were made by an operator in a given week, etc. The operator file keeps up with the persons allowed to use the system.

Figure 12:
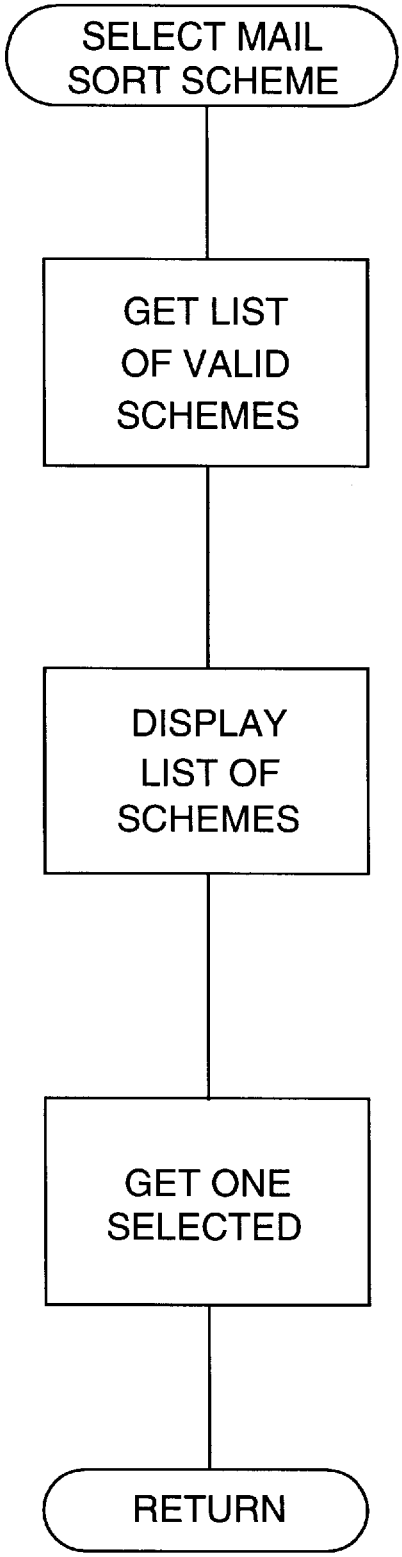

Referring to FIG. 9, the operator logs in, selects the mail scheme as shown in FIG. 12 and the sort mail scheme as shown in FIG. 13.

Figure 10:
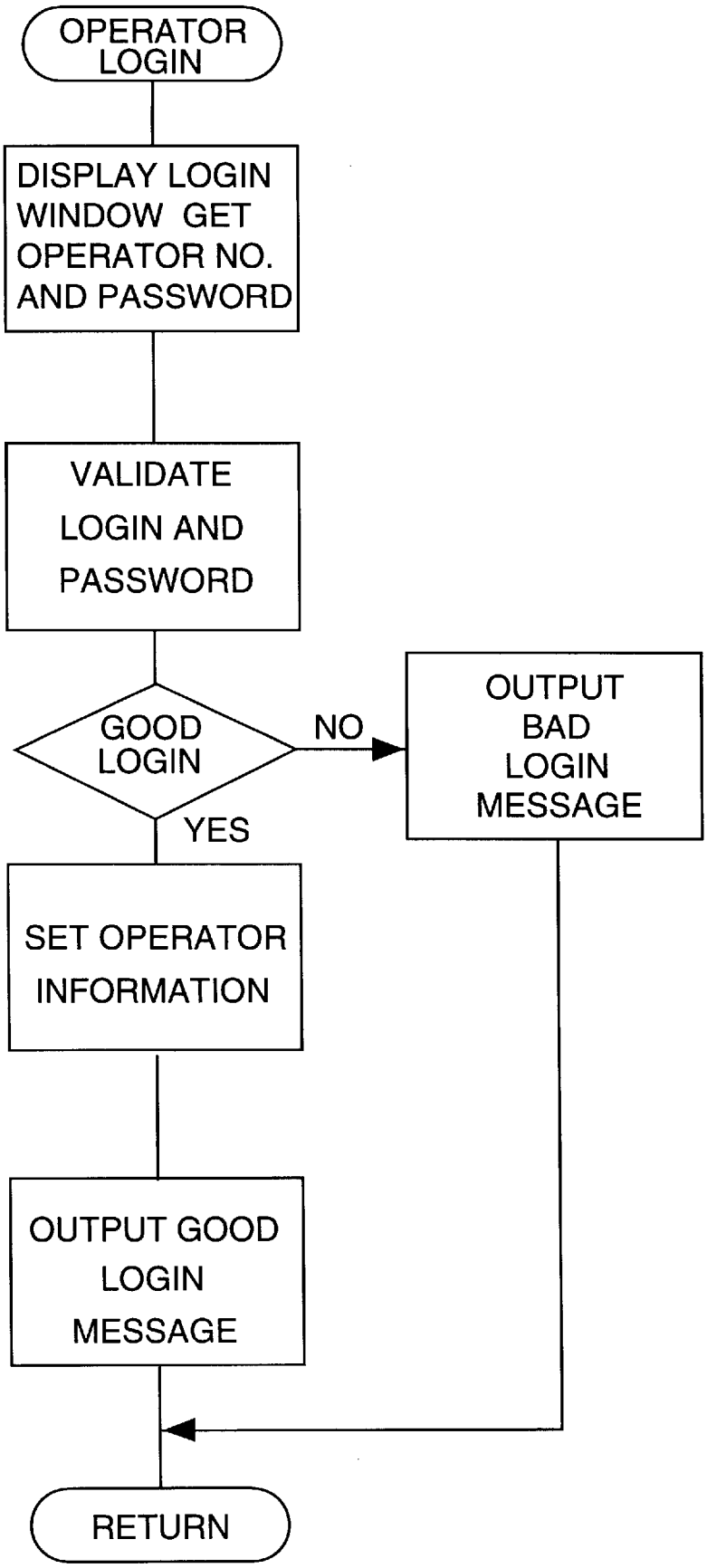

Referring to FIG. 10, the system displays the log in window, and obtains the operator number and password. The set operator information maintains information a Referring to FIG.

Figure 11:
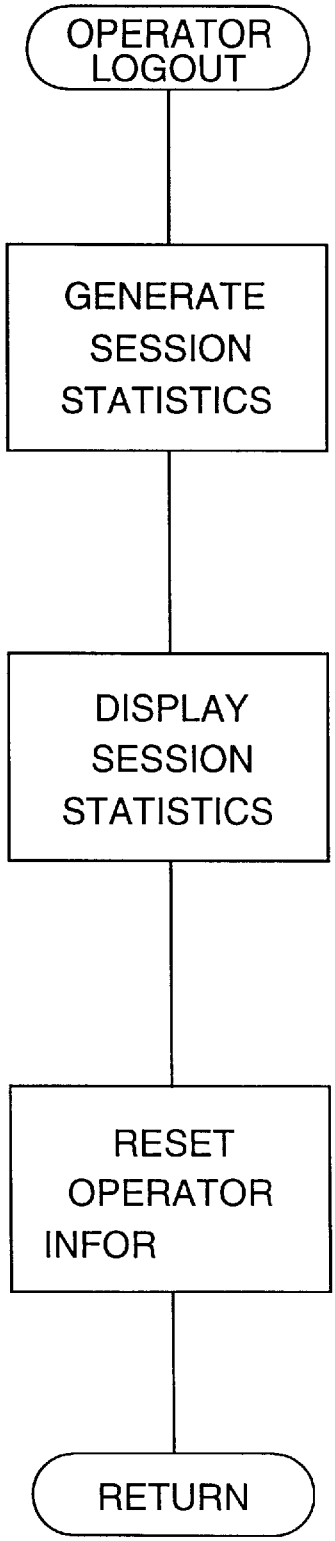

Referring to FIG. 11, in log out of the operator, the system generates statistics about the number of pieces of mail the operator handled during a given session, the number of errors made, etc. which are displayed.

Referring to FIG. 12, the mail sort scheme is selected from a list. For example, a scheme may be made up of a bin number, sorting mail codes and ending mail codes for searching through a table. The search may not find the exact match of a beginning mail code but it may find a match between the beginning and ending mail code for a bin. The list of schemes is displayed and one is selected.

Referring to FIG. 13, the mail is sorted by the scheme selected. A first pass scheme table is built, and the process of FIGS. 14 and 20 carried out and a second pass scheme table is built.

The accept command is shown in FIG. 14. It reads from the keyboard or mouse and in some cases the voice input. The hot key refers to a certain bin number defined by the user. It means that a mail code number is going to be use extensively and it is assigned or translated to a selected one of the F1–F10 keys of the keyboard, for example F1. This facilitates inputting this mail code rather than typing the computer mail code out each time it comes up on the mail pieces.

Referring to FIG. 15, the system processes the mail codes, converts the mail codes to a bin number as shown in FIG. 16, signals the bin numbers as shown in FIG. 17, receives the mail placement signal as shown in FIG. 18, and produces a signal placement error if necessary as showing FIG. 19.

I claim:

1. A system for use for sorting mail pieces or the like, wherein each mail piece has a code number thereon, comprising, structure forming a plurality of bins for receiving mail pieces, a sensing means, warning light and a guiding light located at each of said bins, a computer, an input/output means coupled to said computer, mail code identifying means coupled to said computer for identifying the mail codes of the mail pieces, an input line coupled from each sensing means to said input/output device, an output line coupled from said input/output means to each of said warning lights and to each of said guiding lights.

2. The system of claim 1, wherein said computer is programmed to:

identify the mail codes of the mail pieces and assign bin numbers to the mail codes, read the mail codes and cause said input/output means to turn on the guiding light of the bin associated with each mail code read, cause said input/output means to turn off the guiding light of an associated bin when a mail piece is placed in the associated bin and sensed by the sensing means in the associated bin, cause said input/output means to turn on the warning light of a non-associated bin when a mail piece is placed in the non-associated bin and sensed by the sensing means in the non-associated bin, cause said input/output means to turn off the warning light of the non-associated bin and to turn off the guiding light of the associated bin when the mail piece is removed from the non-associated bin and placed in the associated bin and sensed by the sensing means of the associated bin.

3. The system of claim 1, wherein said computer comprises a computer readable memory and a program stored in said computer readable memory to:

identify the mail codes of the mail pieces and assign bin numbers to the mail codes, read the mail codes and cause said input/output means to turn on the guiding light of the bin associated with each mail code read, cause said input/output means to turn off the guiding light of an associated bin when a mail piece is placed in the associated bin and sensed by the sensing means in the associated bin, cause said input/output means to turn on the warning light of a non-associated bin when a mail piece is placed of the non-associated and sensed by the sensing means of the non-associated bin, cause said input/output means to turn off the warning light in the non-associated bin and to turn off the guiding light of the associated bin when the mail piece is removed from the non-associated bin and placed in the associated bin and sensed by the sensing means of the associated bin.

4. A method of sorting mail pieces for placement in appropriate bins wherein each of said mail pieces has a mail code thereon and a guiding light, a warning light and a sensing means are located at each of said bins, comprising the steps of:

reading the mail codes of the mail pieces, identifying the mail codes of the mail pieces and assigning bin numbers to each mail code read, for each mail code read, turning on the guiding light of the bin associated with said mail code read, placing said mail piece having its mail code read in said associated bin to cause said sensing means to sense said mail piece to turn said guiding light off, in the event that a mail piece is placed in a non-associated bin, causing the sensing means of said non-associated bin to turn on the warning light of said non-associated bin, removing said mail piece from said non-associated bin and placing said mail piece removed from said non-associated bin into the correct associated bin to turn off the warning light of said non-associated bin and to turn off said guiding light of said associated bin.

5. A method of sorting mail pieces for placement in appropriate bins wherein each of said mail pieces has a mail code thereon and a guiding light, a warning light and a sensing means are located at each of said bins, comprising the steps of:

reading the mail codes of the mail pieces, identifying the mail codes of the mail pieces and assigning bin numbers to each mail code read, for each mail code read, turning on the guiding light of the bin associated with said mail code read, placing a mail piece having its mail code read in a non-associated bin, causing the sensing means of said non-associated bin to turn on the warning light of as non-associated bin, removing said mail piece from said non-associated bin and placing said mail piece removed from said non-associated bin into the correct associated bin to turn off the warning light of said non-associated bin and to turn off said guiding light of said associated bin.

* * * * *